US006345562B1

(12) United States Patent
Mannhart

(10) Patent No.: US 6,345,562 B1
(45) Date of Patent: Feb. 12, 2002

(54) METHOD AND DEVICE FOR FEEDING AMMUNITION TO AUTOMATIC CANNON

(75) Inventor: Peter Mannhart, Eschenbach (CH)

(73) Assignee: Oerlikon Contraves AG, Zurich (CH)

( * ) Notice: Subject to any disclaimer, the term of this patent is extended or adjusted under 35 U.S.C. 154(b) by 0 days.

(21) Appl. No.: 09/261,107

(22) Filed: Mar. 3, 1999

(30) Foreign Application Priority Data

Aug. 24, 1998 (CH) ..... 1731/98

(51) Int. Cl.[7] ..... F41A 9/00; F41A 9/61
(52) U.S. Cl. ..... 89/33.16
(58) Field of Search ..... 89/11, 33.01, 33.1, 89/33.16, 33.17

(56) References Cited

U.S. PATENT DOCUMENTS

| | | | | |
|---|---|---|---|---|
| 3,741,069 A | * | 6/1973 | Stewart | 89/11 |
| 3,868,884 A | * | 3/1975 | Rose et al. | 89/11 |
| 4,253,376 A | * | 3/1981 | Washburn et al. | 89/33 |
| 4,550,641 A | * | 11/1985 | Bruderer et al. | 89/12 |
| 5,271,310 A | * | 12/1993 | Muller | 89/33.04 |
| 5,392,685 A | | 2/1995 | Stoner | 89/9 |

FOREIGN PATENT DOCUMENTS

| | | |
|---|---|---|
| EP | 0 458 106 A1 | 11/1991 |
| EP | 0 745 826 A1 | 12/1996 |

* cited by examiner

*Primary Examiner*—Michael J. Carone
*Assistant Examiner*—Michelle Thomson
(74) *Attorney, Agent, or Firm*—Townsend and Townsend and Crew; Guy W. Chambers

(57) ABSTRACT

Cartridges (5) are guided during a loading phase shortly before reaching the automatic cannon (1) onto a first track, which differs from the conveying direction of the conveyor chain (14) and are guided at a greater distance from the revolving drum (13) around the shaft (15) of the revolving drum, and conveyed on. In a firing phase, the cartridges (5) are guided shortly before reaching the automatic cannon (1) onto a second track, which differs from the conveying direction of the conveyor chain (14), are guided around the shaft (15) of the revolving drum (13), and are sequentially brought into a firing position directly behind the revolving drum. After having been fired and ejected, the empty cartridge cases (6) are caught and are transported on the first track into a magazine (4).

2 Claims, 5 Drawing Sheets

METHOD AND DEVICE FOR FEEDING AMMUNITION TO AUTOMATIC CANNON

FIELD OF THE INVENTION

The invention relates to method for feeding ammunition to automatic cannons, wherein cartridges transported by a conveyor chain are transferred to a star wheel arranged coaxially in relation to a revolving drum. The invention further relates to a device for executing the method.

BACKGROUND OF THE INVENTION

Such a device, having a conveyor chain rotating in a housing of a magazine, is known from Swiss Patent Application 01 587/95-6 which is incorporated by reference. Scoops are provided on the conveyor chain, in which cartridges are held during the transport to a drum of an automatic cannon. Star-shaped reversing wheels and star-shaped transfer wheels are arranged on a common rotatable shaft at a reversing point of the conveyor chain facing the drum, wherein the reversing wheels are in engagement with the conveyor chain. A first conveying member provided in the area of the reversing wheels takes over cartridges from the conveyor chain, or respectively the transfer wheels, wherein the cartridges are transported along a guide surface in the shape of an arc of a circle away from the transfer wheels to a second conveying member. The first conveying member consists of two three-pointed stars arranged on a common rotatable shaft, whose gaps are matched to the cross-sectional shape of the cartridges. The second conveying member is also rotatably arranged and has a guide surface for receiving respectively one cartridge. A loading star, extending coaxially in respect to the drum, is fastened on the latter, to which the second conveying member transfers the cartridges. A scanning device, for example in the form of a photoelectric barrier arranged above a cartridge located on the second conveying member, checks the position of the first cartridge. If a cartridge is present, a loading device is activated and the cartridge is pushed into the drum.

The above described device is constructed relatively complicated and has no provisions for removing the empty cartridge case, such as is advantageous in connection with automatic cannons in aircraft, for example.

OBJECT AND SUMMARY OF THE INVENTION

It is the object of the invention to propose a method and a device of the type mentioned at the outset, which do not have the above mentioned disadvantages and are particularly suited for aircraft.

The invention provides a single ammunition conveyor chain for an automatic cannon which can be adjusted for two settings as ammunition is conveyed from the magazine, one for loading and the other for firing, and allows spent cartridges to be collected in the magazine after firing. In operation, shortly before reaching the automatic cannon during a loading phase, the cartridges are deflected into a first track, which is spaced back from the revolving drum and are guided around the shaft of the revolving drum in this spaced back distance from the revolving drum. Shortly before reaching the automatic cannon during a firing phase, the cartridges are deflected into a second track, which differs from the first track by being brought forward into the revolving drum, they are then guided around the shaft of the revolving drum and are brought into a firing position directly behind the revolving drum. The loading phase is a phase between two firing phases, wherein cartridges are fed to the gun which will be used in the firing phase to follow; in other words, during the loading phase, a pre-loading takes place. The firing phase is the phase during firing, wherein cartridges are fed to the gun which are used immediately. After firing and ejection, the empty cartridge cases are caught and transported to a magazine on the first track.

The advantages which can be achieved by means of the invention are the following:

The proposed device with the return of the empty cartridge cases and misfired cartridges permits the automatic loading and unloading of the cannon and is particularly suited for aircraft (unloading the cannon prior to landing) as well as in all cases where it is necessary to operate remotely (difficult access to the cannon).

The continuous movement of the main elements of the conveying system reduces stresses and optimizes energy usage.

The capability of the conveyor chain to store some cartridges compensates for the stepwise movement of the revolving drum.

Further advantages rest in the simple modular structure, dependable operation and simple maintenance.

The invention will be explained in greater detail in what follows by means of an exemplary embodiment in connection with the drawings.

DETAILED DESCRIPTION OF THE PREFERRED EMBODIMENT

Figure 1:
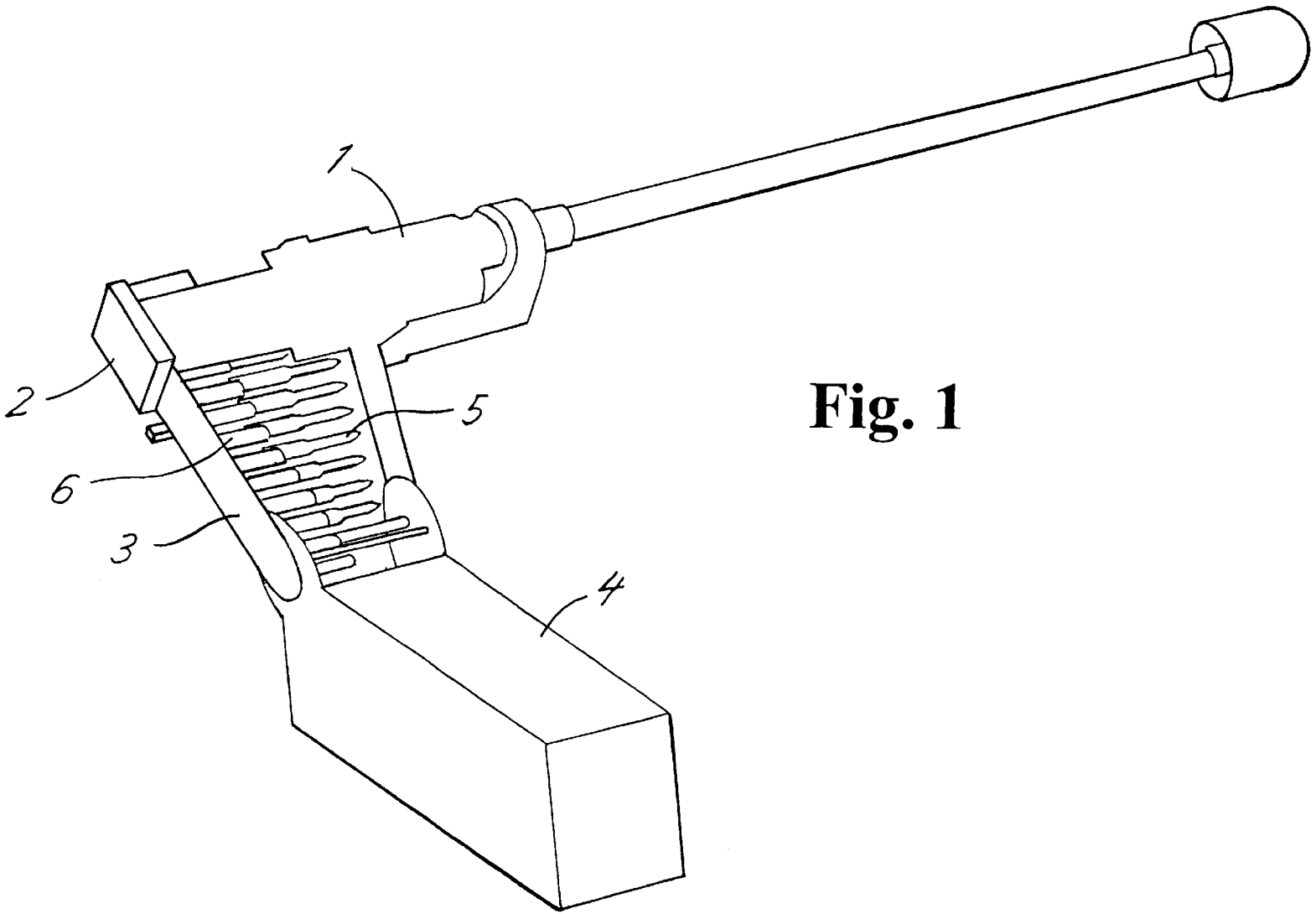
FIG. 1 shows an automatic cannon with the device in accordance with the invention in a simplified perspective representation.
Figure 2:
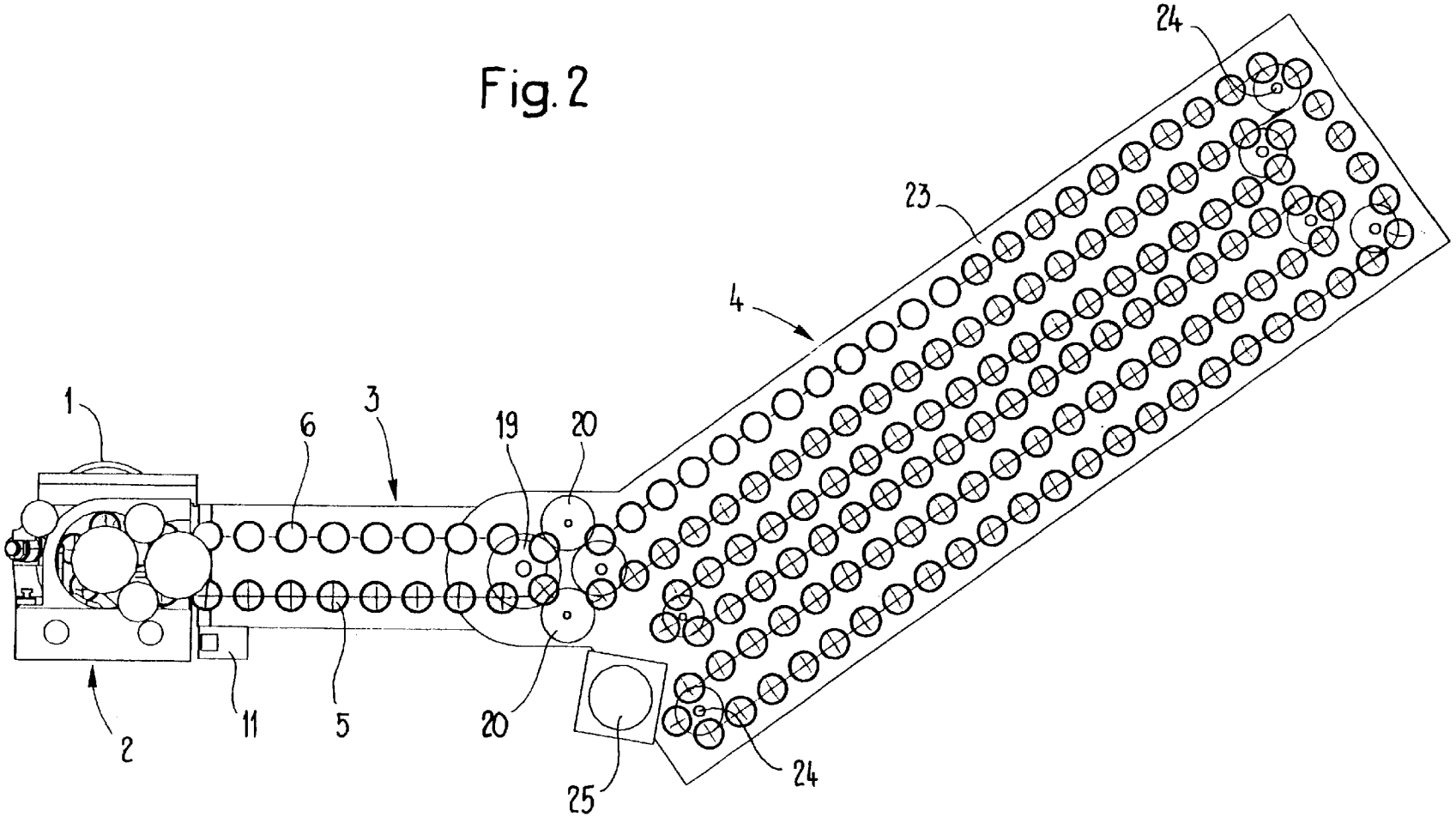
FIG. 2 is a lateral view of the device in accordance with FIG. 1 in a simplified representation.
Figure 3:
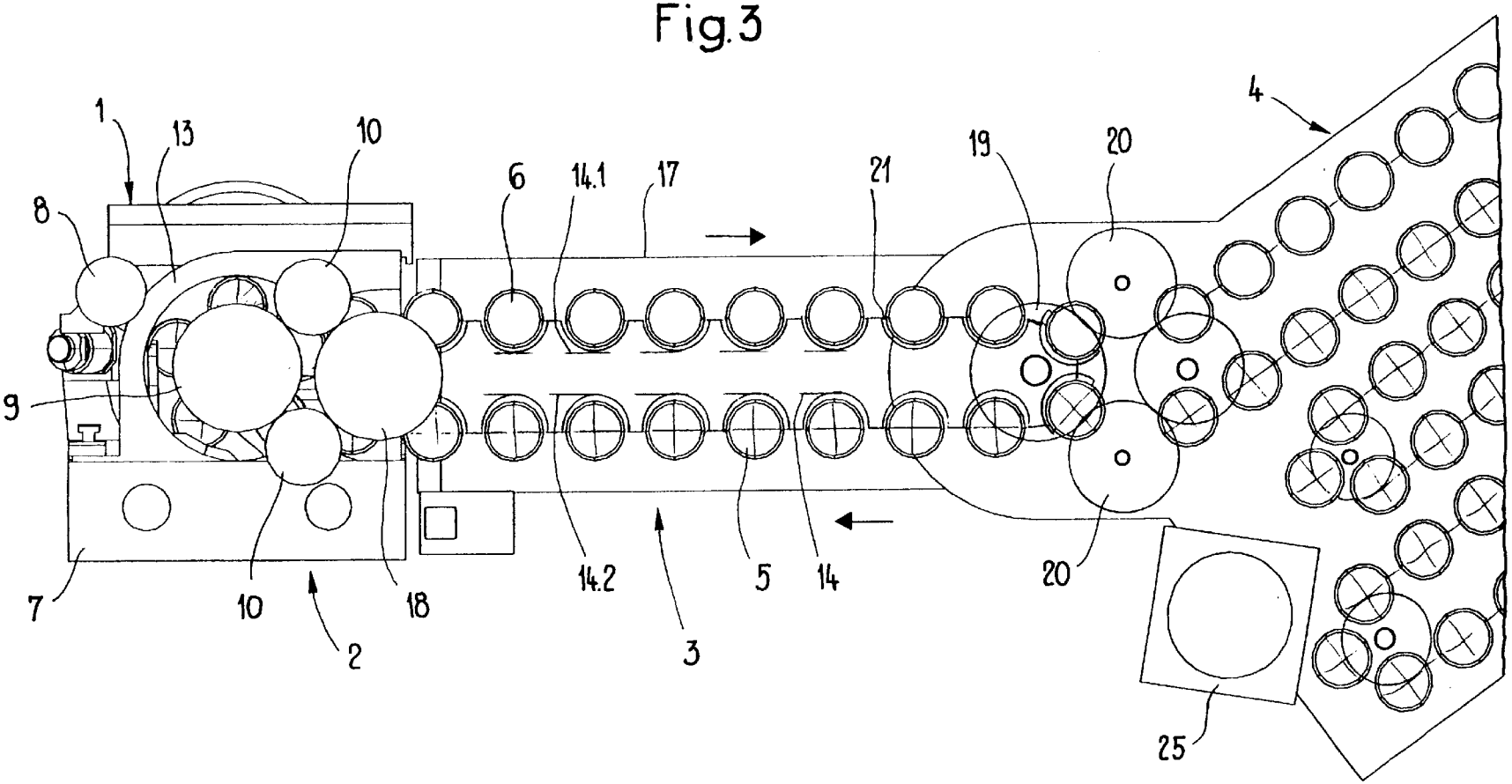
FIG. 3 represents a portion of the lateral view of the device at a scale enlarged in comparison with FIG. 2.
Figure 4:
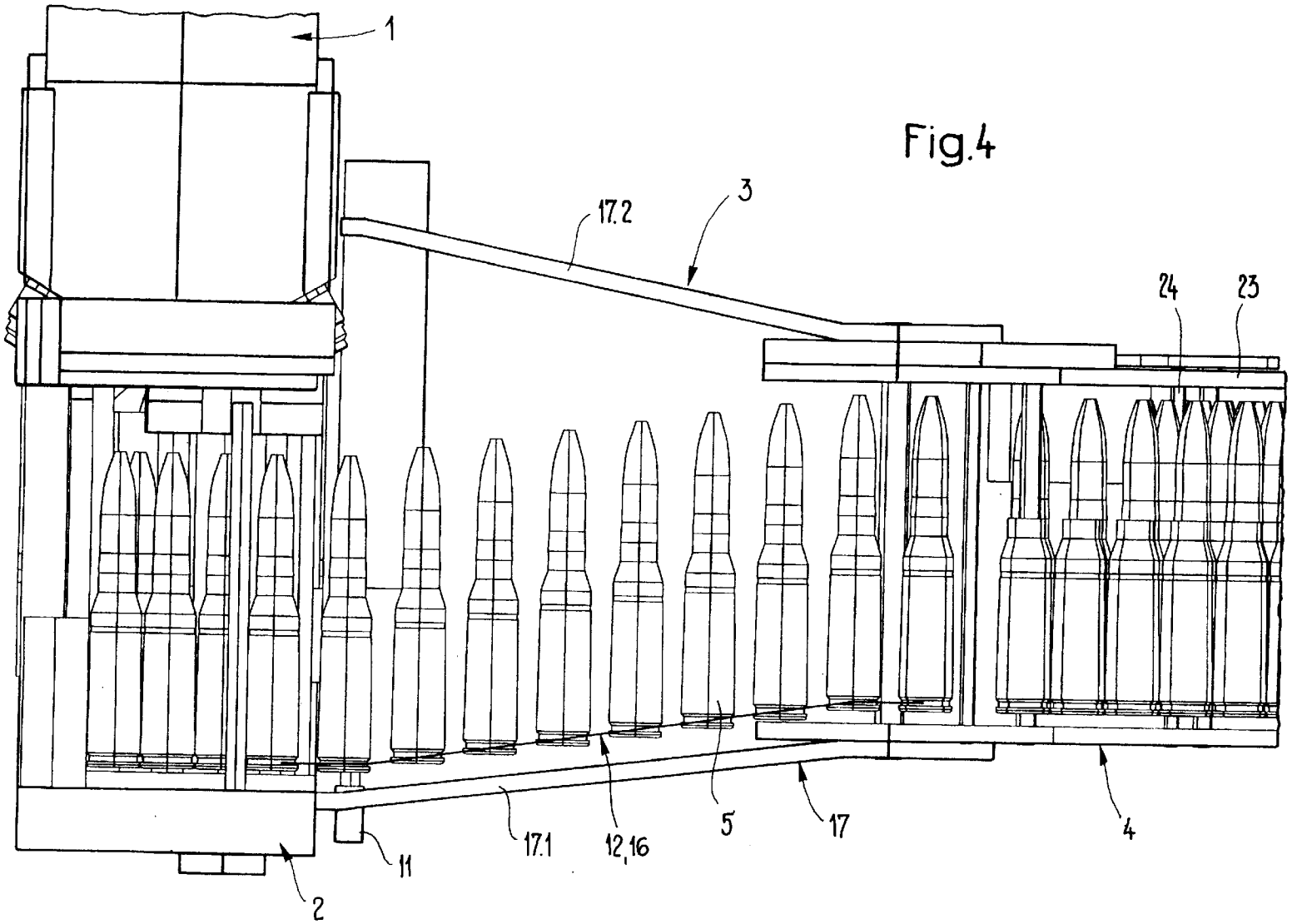
FIG. 4 is a view from above on the device in accordance with FIG. 3 in a loading phase.
Figure 5:
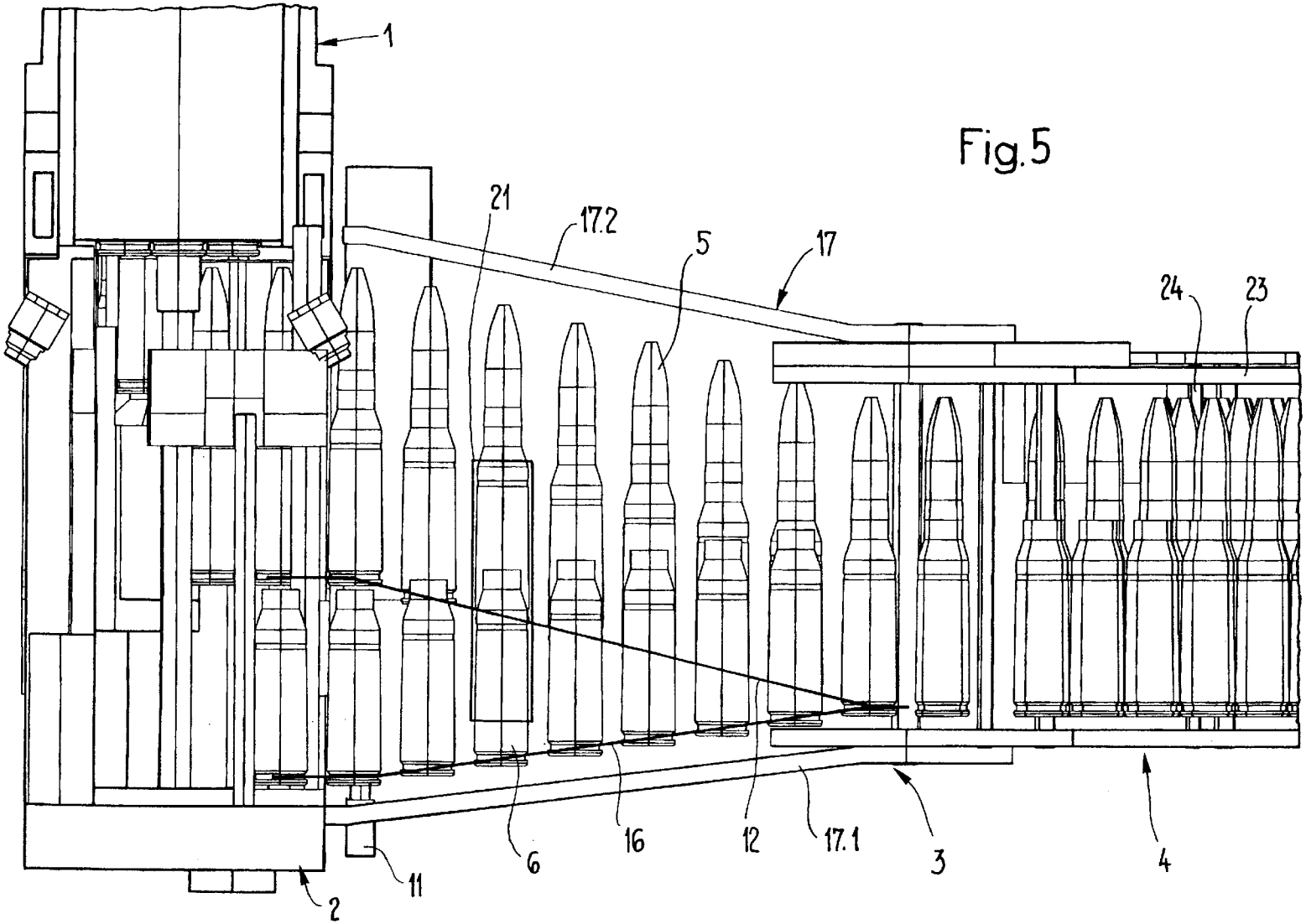
FIG. 5 is a view from above on the device in accordance with FIG. 3 in a firing phase.

An automatic cannon on which a feeder 2 is fastened is identified by 1 in FIG. 1. The feeder 2 is connected with one end of the conveyor 3, whose other end is fastened to a magazine 4. The feeder 2 supplies a revolving drum 13 (FIG. 3) of the automatic cannon 1 with cartridges 5, catches the ejected empty cartridge cases 6 and transfers them to the conveyor 3. The conveyor 3 takes the cartridges 5 out of the magazine 4, transports them to the automatic cannon 1 and conveys the empty cartridge cases 6 back to the magazine 4.

In accordance with FIGS. 2 to 5, the feeder 2 essentially consists of a housing 7, a coupling 8, a star wheel 9, two transport wheels 10, a shunt device 11 for an adjustable guide 12 of the conveyor 3, and an ejection tube and catching device, not shown in detail, for the empty cartridge cases 6. In this case, the star wheel 9 is constructed of two elements, a front element coupled with the revolving drum 13, and a rear element, which can be detached from the front element, or respectively from the revolving drum 13. For reloading, the rear element is detached from the revolving drum 13, and the cartridges can be transported in the rear element around the revolving drum shaft. At the same time, there are still three cartridges in the front element of the star wheel 9, or respectively in the revolving drum 13. Therefore, following reloading, the first cartridge from the conveyor 3 is positioned behind the last one in the front element of the star wheel.

The star wheel 9, which is arranged coaxially in relation to the revolving drum 13, can be coupled to or uncoupled from the latter by means of the coupling 8. During loading of the revolving drum 13, the star wheel 9 holds the cartridges 5, and in addition drives a conveyor chain 14 of the conveyor 3 via a gear. The catching device stops the ejected empty cartridge cases, or respectively cartridges, and transfers them to the conveyor chain 14 of the conveyor 3, wherein the empty cartridge cases 6, or respectively the cartridges 5, are guided by a fixed guide 16 and by the adjustable guide 12 of the feeder 2, or respectively of the conveyor 3. In this case the cartridges 5 can be deflected onto a different track by means of the shunt device 11, or respectively the adjustable guide 12, so that in the course of circling a shaft 15 of the revolving drum 13 they cannot again be inserted into the latter.

The conveyor 3 consists of a housing 17, the conveyor chain 14, the adjustable and the fixed guides 12, or respectively 16, two star wheels 18, 19, and two transport wheels 20. Half-shells 21 for holding the cartridges 5, or respectively empty cartridges 6, are fastened on the conveyor chain 14. The housing 17 has two lateral walls 17.1, 17.2, which are arranged, starting at the magazine 4, spreading out at an acute angle in relation to the conveying direction of the conveyor chain 14 and which reach their greatest distance from each other at the feeder 2. The fixed guide 16 is arranged in the area of the top belt 14.1 of the conveyor chain 14 extending parallel with the one lateral wall 17.1. The adjustable guide 12 is arranged in the area of the lower belt 14.2 of the conveyor chain 14, wherein it extends in a first position parallel with the one lateral wall 17. 1, and in a second position parallel with the other lateral wall 17.2. The conveyor chain 14 is guided around the star wheels 18, 19, which are arranged at both ends of the housing 17, wherein one star wheel 18 can be driven by the feeder 2, and the other star wheel 19 by the magazine 4. The conveyor chain 14 transports the cartridges from the magazine 4 to the feeder 2, and the empty cartridge cases 6 from the latter back to the magazine, wherein the transport wheels 20 assist the transport from and to the star wheel 19, or respectively a conveyor chain 22 of the magazine 4, to the conveyor chain 14 of the conveyor 3 and back.

The magazine 4 has a housing essentially consisting of two plates 23, connected by spacing columns, and a cover. Bearings for shafts 24 and guide grooves for the conveyor chain 22 are provided in the plates 23. The conveyor chain 22 consists of two endless roller chains, on which cup-shaped holders are fastened, which are matched to the cartridges 5, or respectively the empty cartridge cases 6. Guides for the cartridges 5, or respectively the cup-shaped holders, are arranged on the spacing columns. The chain links of the roller chains are connected with each other with play, so that the distance between two chain links can be increased or shortened, by means of which a buffer effect can be created and a few cartridges 5 can be stored.

The conveyor chain 22 is guided around shafts 24, some of which are driven by pinions on the exterior of the plates 23. One of the shafts 24 is embodied in such a way that it can be manually rotated from the outside. A servo motor 25, also fastened on the exterior of one of the plates 23, is used for driving the conveyor chain 22. The housing of the magazine 4 has a door with a loading ramp for loading cartridges 5 and unloading empty cartridge cases 6.

The above described device operates as follows:

During loading (FIG. 4), the adjustable guide 12 is pushed into the first position by means of the shunt device 11, in which it is congruent with the fixed guide 16. In this position the cartridges 5 are transported via the transfer wheel 10 and the star wheel 9 from the direction of the lower belt 14.2 around the shaft 15 past a device for the insertion of the cartridges 5 into the revolving drum 13. During the loading process the rear element of the star wheel 9 is disengaged from the revolving drum 13, and the servo motor 25 drives the conveyor chains 14, 22 until the cartridges 5 being inserted into the opening of the magazine 4 and grasped by the cup-shaped holders of the conveyor chain 22 have reached the maximum number to be inserted.

During firing (FIG. 5), the adjustable guide 12 is pushed into the second position by means of the shunt device 11, so that the cartridges 5 are transported from the direction of the lower belt 14.2 of the conveyor chain 14 directly in front of the revolving drum 13, and the device for inserting the cartridges 5 becomes active. It is known for the revolving drum 13 to be driven by the back-and-forth running slide. This slide drives the revolving drum 13 via an integrated control cam and displaces the cartridges 5 axially via integrated cams into the cartridge position in the revolving drum 13. During firing the slide is accelerated backward via a gas piston by means of the firing gases, and two springs are prestressed in the process, which bring the slide forward again. Since no firing gases are available during the loading of the cannon (three cartridges), the slide is driven for this by means of a special drive piston either hydraulically, pneumatically or pyrotechnically. Since in this phase the revolving drum 13 is coupled with the rear element of the star wheel 9 and therefore with the conveyor chain 14, the respectively next cartridge 5 is brought into the firing position by the rotation of the revolving drum 13. Because of the buffer effect of the conveyor chain 22 of the magazine 4, the revolving drum 13 need only pull a few cartridges 5 here. During the same time the servo motor 25 is switched on to again produce the buffer effect of the conveyor chain 22. The empty cartridge cases 6 ejected after firing are caught by the catching device, transferred to the upper belt of the conveyor chain 14 and returned along the fixed guide 16.

The operation of the device is monitored by sensors and regulated from a central control device. In this case, the sensors provide information to the feeder 2, for example regarding the position of the star wheel 9, the position of the adjustable guide 12, the position of the coupling 8 and the presence of a cartridge 5 in a feed position at the revolving drum 13. The sensors of the magazine 4 provide information regarding the servo motor 25 and the position of the loading door as well as the correct loading operation.

In the foregoing specification, the invention has been described with reference to specific preferred embodiments. It will, however, be evident to those of skill in the art that various modifications and changes may be made without departing from the broader spirit and scope of the invention as set forth in the appended claims. Accordingly, the specification and drawings are to be regarded in an illustrative, rather than restrictive, sense; the invention being limited only by the appended claims.

What is claimed is:

1. A method of conveying ammunition cartridges in an automatic gun comprising the steps of:

using a single conveyor chain to transport live ammunition cartridges from a gun magazine to a revolving firing drum of said gun;

urging said live ammunition cartridges into either a rearward first track on said single conveyor chain or onto a forward second track on said single conveyor chain wherein said rearward first track guides said ammunition cartridges around the axis of said revolving firing drum in a position which is spaced back from a firing position and said forward second track guides said ammunition cartridges around said revolving drum axis in a firing position; and, after firing, transporting empty cartridge shells on said single conveyor chain away from said revolving firing drum so that said empty cartridges can be returned to said gun magazine.

2. The method of claim 1 wherein said automatic gun is an automatic cannon.

* * * * *